United States Patent [19]

McCain et al.

[11] 4,046,366

[45] Sept. 6, 1977

[54] METHOD FOR PRODUCING BOOKS

[75] Inventors: William B. McCain, Hinsdale; James F. Cosgrove, Western Springs; Arthur E. Eaves, Morton Grove, all of Ill.

[73] Assignee: McCain Manufacturing Corporation, Chicago, Ill.

[21] Appl. No.: 694,221

[22] Filed: June 9, 1976

[51] Int. Cl.[2] ..... B41F 13/56

[52] U.S. Cl. ..... 270/21; 270/32; 270/54; 270/61 R

[58] Field of Search ..... 270/37–38, 270/53, 4–6, 10, 16, 18–21, 32, 41, 43, 94, 84, 61 R; 11/1 ET, 1 R

[56] References Cited

U.S. PATENT DOCUMENTS 3,237,934 3/1966 Rosenberg ..... 270/53

*Primary Examiner*—Edgar S. Burr
*Assistant Examiner*—A. Heinz
*Attorney, Agent, or Firm*—Kinzer, Plyer, Dorn & McEachran

[57] ABSTRACT

Books are produced by juxtaposing webs of printed material obtained from rolls, cut and then folded twice to afford a lap margin and a juxtaposed fold before delivery to a saddle conveyor; the folded sheets or signatures thus produced are trimmed and one trim is at the aforementioned juxtaposed fold.

3 Claims, 10 Drawing Figures

METHOD FOR PRODUCING BOOKS

This invention relates to a machine and method for producing books characterized by signatures joined at a folded back.

This invention was prompted by consideration of the disclosure in application Ser. No. 441,056 filed Feb. 11, 1975, now U.S. Pat. No. 3,966,185 and one object of the present invention is to increase productivity, possible under the machine of that patent, by producing two folds in the signature pre-forms (juxtaposed sheets) which are joined by glue. Another object of the present invention is to so produce the folds that one fold becomes the back of the book to be stitched while the other fold contains the line of glue and is so located as to be separated by a trimming knife along with a lap margin.

A large portion of the disclosure repeats part of the disclosure in application Ser. No. 441,056, filed Feb. 11, 1974, now U.S. Pat. No. 3,966,185. One difference resides in the manner of folding and trimming.

Figure 1:
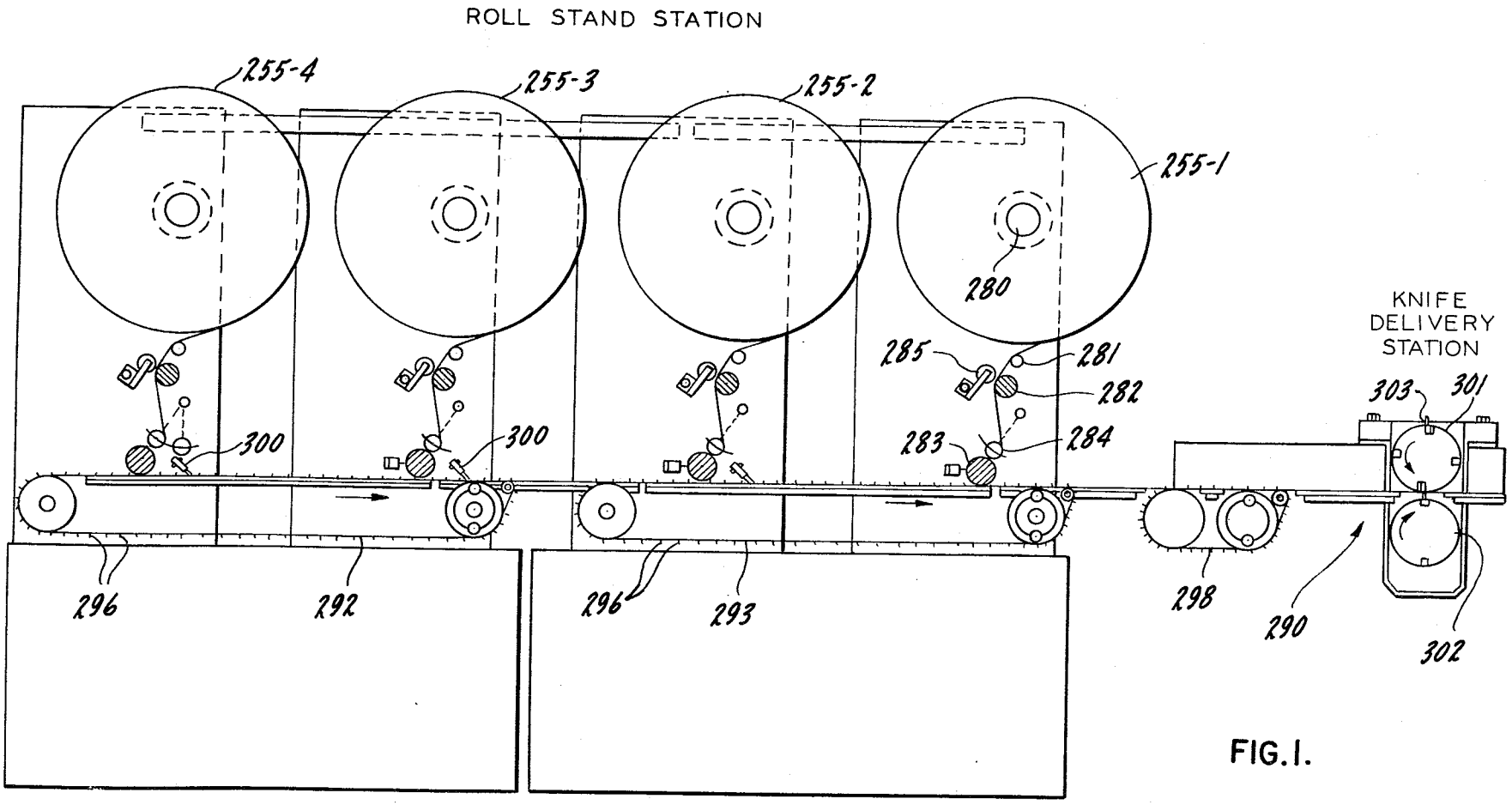
FIG. 1 is a sectional view of the roll stand and the knife delivery means.

FIG. 1 is a schematic, partly diagramatic plan of a system for producing glue-backed books from rolled webs. The rolls of web material, pre-printed in page relation, are assembled at a roll stand station. As shown in FIG. 1, the webs are withdrawn from individual rolls, glued, collated, and fed to a knife delivery station where the registered webs are severed transversely. The product obtained at the knife delivery station may be viewed as a multiple page pre-form signature, one not yet folded, but in any event a multiple page assembly of sheets, identified by reference character 250 in FIG. 2. This signature pre-form is advanced to a transfer station, FIG. 2, and from thence at right angles along a different path to a folder station by way of a transfer conveyor. The sheet material transferred to the folder station is essentially in the same form, 250.

Figure 2:
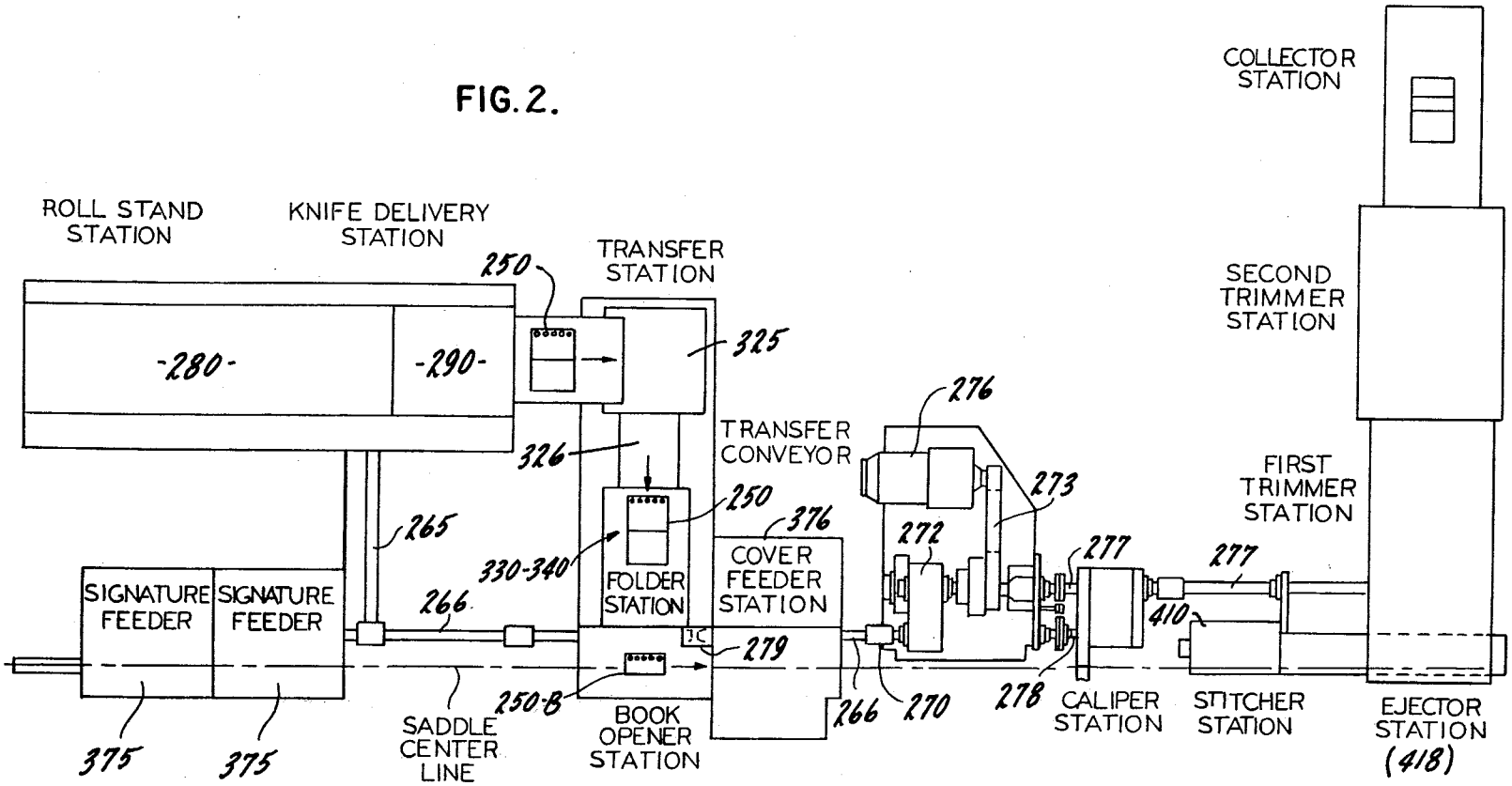
FIG. 2 is a partly diagramatic and partly schematic drawing of the means employed under the present invention to make signatures and produce books therefrom.

The juxtaposed sheets are folded into signature form and fed to a book opener station, FIG. 2, thereby preparing the book for delivery to a saddle conveyor.

As shown in FIG. 2 individual signature feeders may be located upstream of the book opener and a cover feeder may be located downstream. In other words, the glued book at the book opener station may itself be deposited atop signatures delivered by the saddle conveyor to the book opener station, and afterwards a cover (in reality another signature) may be juxtaposed at the cover feeder station.

The book thus assembled from the gathered signatures is delivered by the saddle conveyor to a caliper station and from thence to a stitcher station.

If an imperfect book is detected by the caliper, the stitcher heads are disabled; the insufficient book is discarded at the ejector station, FIG. 2, prior to delivery to the trimmers where the book is trimmed, resulting in the finished product.

Figures 3, 7:
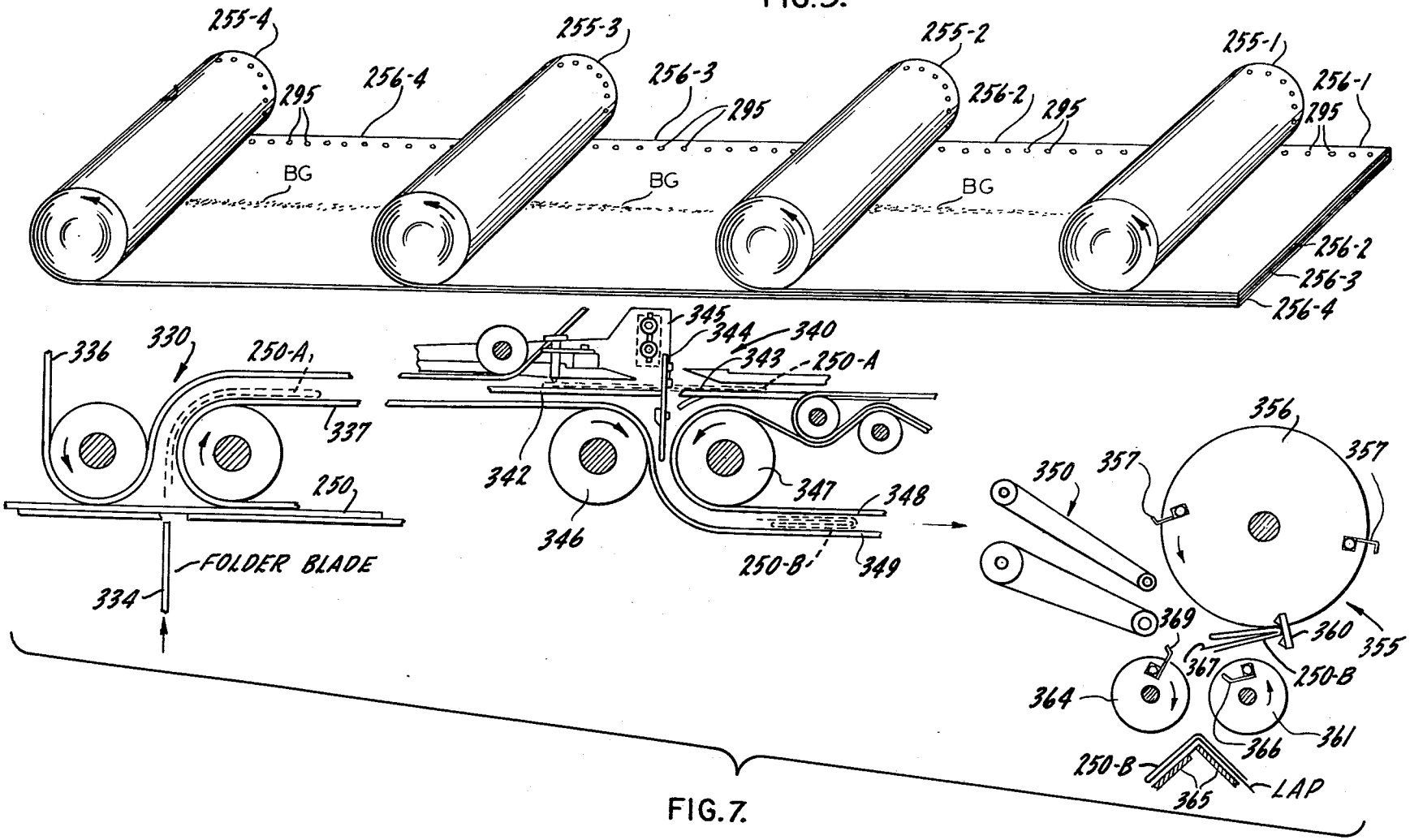
FIGS. 3 through 6A are views showing the steps of book production.
FIG. 7 is an assembly view of folders, a signature feeder and a signature divaricator.

In FIGS. 3 - 6, the stages of constructing or composing a book (a check register book for example) are shown. Assuming there are four roll webs at the roll stand, rolls 255-1, 255-2, 255-3 and 255-4, the webs unwound are, respectively, 256-1, 256-2, 256-3 and 256-4, FIG. 3. In connection with the disclosure thus far made, it is important to bear in mind that the unwound webs are fed forwardly in the direction of the arrows shown in FIGS. 1 and 3. Web 256-1 is laid down first on a pin register belt as will hereinafter be described, and the remaining webs, in the order identified, are juxtaposed one atop the other on web 256-1. A line of glue (which may be repetitious glue beads) is despoited between juxtaposed webs as shown in FIG. 3.

Figure 4:
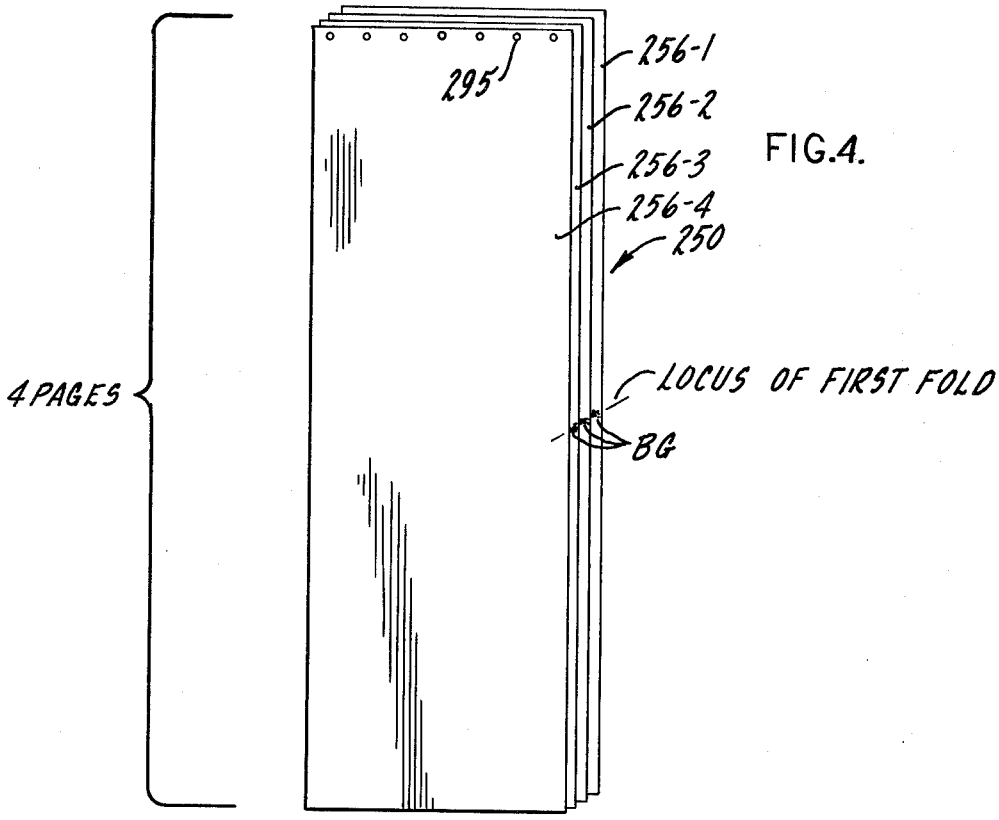
Figure 5:
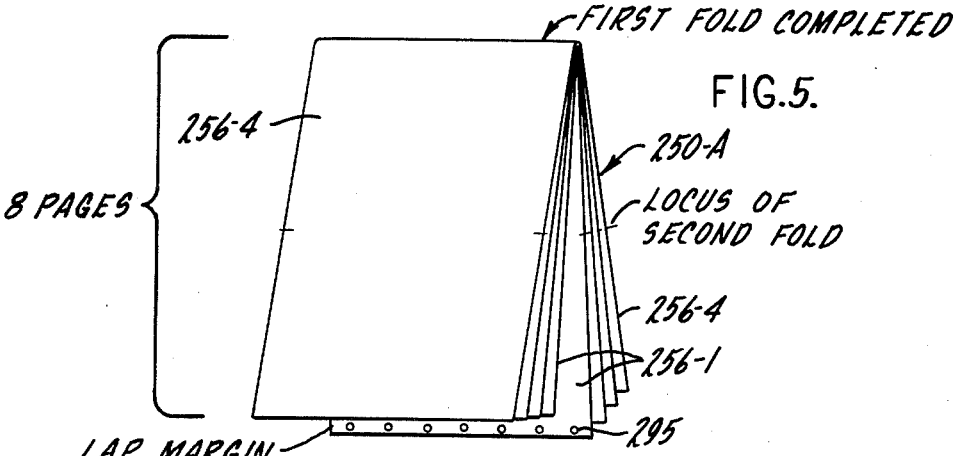
Figure 6:
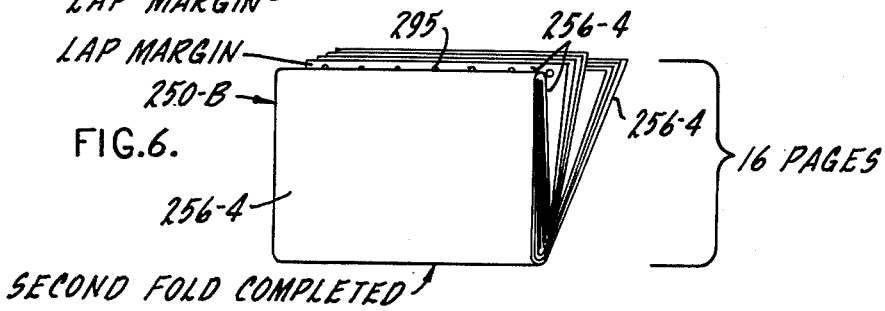

A representation of pagination is shown in FIGS. 4, 5 and 6. The webs are so printed that by making a first fold at the locus of the glue line and then making a second fold parallel to the first, sixteen printed pages will be properly juxtaposed.

When the webs are juxtaposed and properly registered, there is a constant stream of signature pre-forms being produced at the knife station. It must be remembered, however, that the illustration given for pagination is related to only one form of production herein disclosed wherein four rolls are used and wherein the juxtaposed sheets are inverted as hereinafter disclosed, among other things. By making a double fold, the number of rolls is half that required for only a single fold. Also, the folds are so made that the books may be stitched at the backbone (second fold) and then trimmed to both remove a waste margin and to open the edges at the first fold.

As shown in FIG. 2, the pre-form book or signature product emerging from the knife station is identified by reference character 250; it is not yet folded. At the transfer station this product, considered as a juxtaposition of four sheets, is inverted. This accounts for sheet (web) 256-1 being uppermost in FIG. 3 where the webs are shown as being assembled, while in FIG. 4 sheet 256-4 is uppermost.

The inverted sheet assembly 250 shown in FIG. 4 is transferred to the folder station at right angles to its original delivery path. This sheet assemblage is folded twice before delivery to the book opener station. The completely folded product is identified by reference character 250-B in FIGS. 2 and 6. At the book opener or divaricating station, the folded book is opened, FIG. 7, incidental to depositing it on the saddle conveyor.

The rolls are supported on spindles 280, FIG. 1. The unwound length of the web is trained about an idler roll 281, then around an infeed roll 282 and from thence between a guide roll 283 and associated dancer roll 284, the latter being used as a control brake to regulate the rate of web feed. Roll 283 guides the web onto a pin register belt to be identified below.

The feeder roll 282 is driven positively so that it, together with an associated nipper roll 285, is responsible for withdrawing and feeding the web material from the web rolls to the pin register belt.

The web material is advanced in the direction of a rotary knife assembly 290 constituting the knife delivery station, and this is accomplished by laying the webs, one atop another, on a pair of tandem end-to-end pin register belts 292 and 293 travelling beneath the spindles. At the commencement of a run, the leading ends of the webs are accurately registered in page to page relationship by the supervisor, and this is accomplished in part by providing punched, pin register openings 295, FIG. 3, spaced equidistantly from one another along one edge of each web. The register belts 292 and 293 are provided with feed pins 296, spaced in accordance with the register openings 295. The register openings are only at one edge of the webs for reasons to be explained.

The pin feeders 292 and 293 perform a registering and collecting function. Thus, the principal means for feeding and advancing the webs is represented by the engaged rollers 282 and 285; the pin register belts do not pull the web material from the rolls but merely maintain forward motion of the juxtaposed webs, moving the juxtaposed webs forwardly to a third register pin belt 298 which advances the juxtaposed webs to the knife assembly 290.

A bead of glue BG, FIG. 3, is deposited substantially midway of the width of each of the webs 256-2, 256-3 and 256-4. The bead of glue is slightly off center, in view of the way the juxtaposed sheets are to be folded, and for this same reason the register openings are confined to one edge of the webs. Thus, the register openings serve no purpose in the completed book and are trimmed off as explained in the aforesaid patent, but unlike the disclosure of the patent the glue line is so positioned in accordance with the present invention that it is also trimmed off. Thus, when the final fold is made the register openings are presented at what constitutes the extended lap margin (see FIG. 7) of the folded sheets.

Each bead of glue is deposited by nozzle 300, FIG. 1. The glue may be a "hot melt", supplied from a reservoir, not shown.

The knife assembly 290 includes a rotary knife holder 301 and an opposed rotary anvil 302. The knife holder 301 carries knives 303 which are so displaced as to sever the juxtaposed webs transversely, that is, at right angles to the glue bead in the desired length. The transverse cuts are made repeatedly of course, cutting at the head and foot of successive pre-form books, resulting in a constant stream of four juxtaposed sheets which are to have the first fold made at the glue line. Head-to-foot registration of the juxtaposed pages is maintained by the glue.

Figures 8, 9:
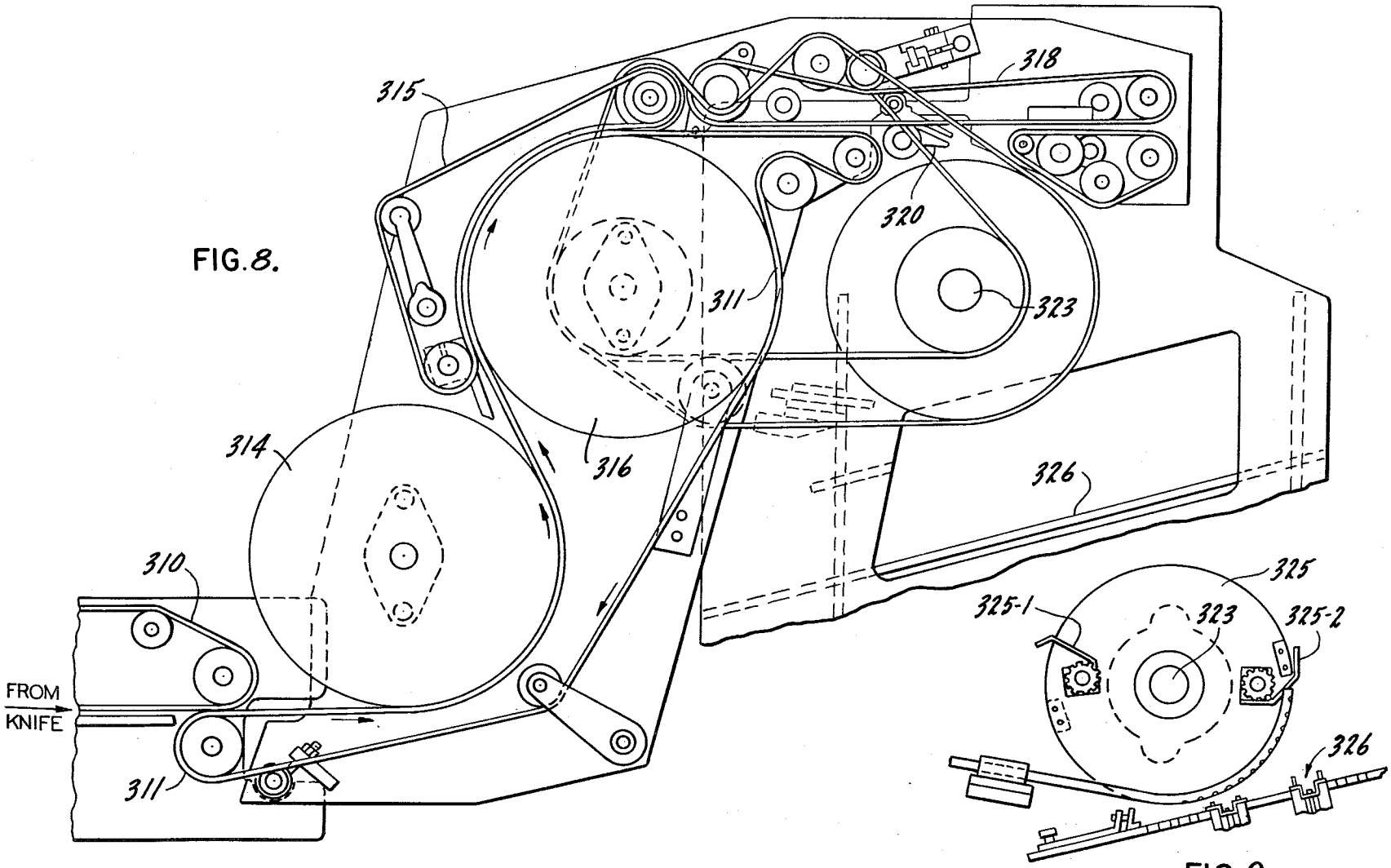
FIG. 8 is an elevation of means employed to transfer sheet material from the knife delivery to the folder.
FIG. 9 is a side elevation of a delivery cyclinder.

As will be apparent in FIG. 2, the path of movement of the web material from the roll stand to the rotary knife is parallel to the saddle conveyor, but this direction is turned 90° at the transfer station incidental to delivering the sheets to the folder station where the sheets joined by glue are folded into signature form. The means for accomplishing this transfer are shown in FIGS. 8 and 9. Original registration, in the meantime, is maintained by the glue; indeed, until the signatures are stitched.

The book or signature pre-forms, constantly separated from the webs by the rotary knife, are fed horizontally one by one to the bight of engaged feed belts 310 and 311, FIG. 8, the latter being trained around rotary guide discs 314 so that the glued, registered sheets are elevated and moved upwardly. This gain in altitude is accomplished because the roll stand and rotary knife are at one level for convenience while the transfer conveyor (326, hereinafter) is at another level.

Another series of feed belts as 315 are opposed to the belts 311 and belts 311 are extended to another set of rotary guide discs 316. From thence the pre-form signatures or books are fed forwardly by means of additional feed belts 318 opposed to the feed belts 311, and at this point a guide means as 320 is positioned to deliver the sheet material to a transfer cylinder.

The aforementioned transfer cylinder to which the books may be delivered by guide 320 is co-axial with shaft 323, FIG. 8, and the transfer cylinder itself, 325, is shown in FIG. 9, positioned above the transfer conveyor 326 which transfers the books to the folding station.

The transfer cylinder 325 has grippers thereon, 325-1 and 325-2, effective to deposit at least two signature pre-forms on the conveyor 326 during each cycle of rotation. Furthermore, the transfer conveyor 326 is disposed beneath the transfer cylinder to receive the sheet material released therefrom, transferring the same forwardly to the folding station.

It will be recognized that the pre-form books or signatures, four sheets thick and not yet folded (see FIG. 4) are inverted by the transfer cylinder 325. In other words, the pages that were uppermost on delivery to the feed belts 310 and 311 are lowermost on the transfer conveyor 326.

The sheet assembly 250, FIG. 4, is horizontally by the transfer conveyor 326 to the first folder 330, FIG. 7. The register openings 295 are in trailing position. This folder is constructed and operates similar to the second folder 340, FIG. 7 (to be described in more detail below) in that the sheet assembly is fed to a stop and so positioned that a folder blade 334 (when driven upwardly) folds the sheet assembly (first fold at the glue line) and delivers it to a pair of feed belts. These feed belts are identified by reference characters 336 and 337; they feed the folded book 250-A to the second folder 340. Completion of the first fold is facilitated by the wet glue. The first fold is so made that the register openings 295 are at an extended lap margin, FIG. 5.

Both folders may take the form of the folder disclosed in full detail in U.S. Pat. No. 3,749,394. The folded sheet material is fed forwardly from the first folder to the second folder 340 until the leading end (the fold) is engaged with a stop, not show, so that the folded sheet assembly 250-A spans the gap presented by a pair of spaced support plates 342 and 343. At this time a folder or tucker blade 344 carried by a reciprocal support 345 is in an uppermost position; it then descends to force the once-folded signature material between a pair of folder rollers 346 and 347, resulting in a second fold, FIG. 6. The second fold is so made that the line of glue, inside the first fold, is within the lap margin trim line to be removed along with the register pin openings 295. The space between the folder rollers is exaggerated in FIG. 7 for clarity. A neat, sharp fold is indeed made. The folder blade support is cycled constantly by a cam, not shown.

The emergent folded material 250-B, FIG. 7, is advanced by feed belts 348 and 349 to an intermediate feeder 350 associated with a signature divaricating means 355.

The signature divaricator 355 includes a transfer cylinder 356 having grippers 357, effective to withdraw the twice-folded sheet assembly 250-B from the exit end of the infeeder 350, moving it counterclockwise as viewed in FIG. 7 until the backbone (second fold) is engaged with and released to a register guage 360.

A pair of opening or divaricating cylinders 361 and 364, FIG. 7, are located beneath the transfer cylinder 356. Cylinder 361 carries a gripper 366 effective to clamp the extended lap margin 367 of the book 250-B positioned by the register guage 360, extracting the book. Gripper 369, on the other hand, is effective to clamp the short margin or leg of the book and together the two grippers 366 and 369 spread the two sections of the book to fit the saddle 365 of the saddle conveyor.

Though by no means necessary, there may be one or more signature feeders 375 of conventional form located upstream of the book opener station. These additional, conventional feeders are sometimes referred to as "pocket" feeders, and there may be a similar cover feeder 376 downstream of the book opener station constituting the last signature to be added.

The signatures on the saddle 365 have the folded back uppermost. Feeder pins on a conveyor chain (not shown) project upwardly through a slot at the top of the saddle 365 (see FIG. 7) and are effective to engage the trailing edge of the group of "signatures" resulting from the folds, moving the corresponding book to a caliper station, FIG. 2, and from thence to the stitcher station as described in more detail in the aforesaid patent.

The forward travel of the saddle conveyor chain terminates at a point where the book is removed one cycle from the stitcher station 410 and at this point the conveyor chain starts its return run or flight. At the stitcher station, staples are driven through the backbone of the book in the conventional manner. The stitched book is advanced through and from the stitcher station to the trimmers, but any incorrect book is first ejected at the ejection station 418 as described in the aforesaid patent.

Figure 6A:
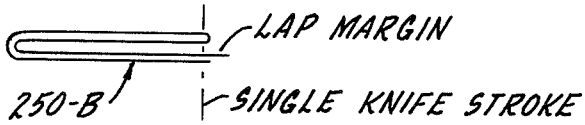

The trimmers, FIG. 2, both in the first trimming station and second trimming station, may be of any desired form; head and foot trimming may not always be necessary. In any event, under the present invention, the lap margin is trimmed off and at the same time (by one knife stroke) the first fold which contains the glue line is separated as shown in FIG. 6A where only one folded sheet is shown for clarity.

The operating members at the roll stand and knife delivery station, FIG. 2, are driven by a shaft 265 in turn driven through proper gearing (not shown) by a shaft 266. Shaft 266 drives the conveyor chain associated with the saddle conveyor and in turn is driven through a coupling 270 and gear reducer 272. The gear reducer 272 is driven by a belt 273 in turn driven by a motor 276.

The gear reducer 272 is also used to drive a shaft 277 which drives the stitcher heads, the ejector and the equipment at the trimming station. A shaft 278 for driving the caliper is geared to shaft 277.

The equipment at the transfer station and the folder are driven through a clutch 279 which receives its input from shaft 266.

We claim:

1. A method of making a book comprising:

a. juxtaposing webs of printed material and registering the webs in pre-paged relationship by register means located along one edge of the webs;

b. cutting the juxtaposed webs to produce juxtaposed sheets to be folded;

c. folding the juxtaposed sheets once along a first fold parallel to said one edge to dispose the register means at an extended lap margin;

d. folding the once-folded sheets along a second fold parallel to the first to locate the first fold adjacent the lap margin, thereby providing a group of signatures having a backbone afforded by the second fold;

e. stitching said backbone to join the signatures; and f. separating the extended lap margin along a trim line which includes the fold line of the first fold, thereby to open the pages of the book.

2. A method according to claim 1 including the steps of depositing a longitudinal area of glue between the webs thereby to maintain the juxtaposed sheets in registry while they are being folded, and making the first fold at the glue area.

3. A method according to claim 2 wherein the second fold is so made that the glue area is within the trim line so that the glue area is removed along with the lap margin.

* * * * *